US009038674B2

(12) United States Patent
Steele

(10) Patent No.: US 9,038,674 B2
(45) Date of Patent: May 26, 2015

(54) PAINT CAN COVER ASSEMBLY WITH PAINT RETURN PORT

(71) Applicant: Shane Steele, Dacula, GA (US)

(72) Inventor: Shane Steele, Dacula, GA (US)

(73) Assignee: SPS Lid Technology II, LLC, St. Johns, FL (US)

( * ) Notice: Subject to any disclaimer, the term of this patent is extended or adjusted under 35 U.S.C. 154(b) by 50 days.

(21) Appl. No.: 13/918,037

(22) Filed: Jun. 14, 2013

(65) Prior Publication Data

US 2014/0367406 A1 Dec. 18, 2014

(51) Int. Cl.
*B67D 3/00* (2006.01)

(52) U.S. Cl.
CPC ..... *B67D 3/0061* (2013.01)

(58) Field of Classification Search
USPC ..... 141/312, 319, 343, 362, 363, 364; 220/495.02; 222/1, 472
See application file for complete search history.

(56) References Cited

U.S. PATENT DOCUMENTS

| | | | | | |
|---|---|---|---|---|---|
| 2,528,530 | A | * | 11/1950 | Machleder | 206/222 |
| 2,719,628 | A | * | 10/1955 | Ivanoff | 206/221 |
| 3,704,007 | A | * | 11/1972 | Kroeger | 366/248 |
| 4,022,344 | A | * | 5/1977 | Roamer | 220/4.03 |
| 4,253,504 | A | * | 3/1981 | Rosen | 141/106 |
| 4,798,287 | A | * | 1/1989 | Groves et al. | 206/219 |
| D325,170 | S | * | 4/1992 | Frantz | D9/447 |
| 5,257,650 | A | * | 11/1993 | Fisk et al. | 141/9 |
| 5,533,802 | A | | 7/1996 | Garganese | |
| 5,622,289 | A | * | 4/1997 | Dedoes | 222/472 |
| 5,660,302 | A | * | 8/1997 | Trout | 220/790 |
| 5,799,813 | A | * | 9/1998 | Letica | 220/254.1 |
| 5,941,427 | A | | 8/1999 | Speer | |
| 6,032,705 | A | * | 3/2000 | Murphy et al. | 141/346 |
| 6,419,385 | B1 | * | 7/2002 | Walls | 366/247 |
| 6,761,287 | B2 | | 7/2004 | Caruso | |
| 7,384,188 | B2 | * | 6/2008 | Waggoner et al. | 366/247 |
| 7,540,652 | B2 | * | 6/2009 | Krzywdziak et al. | 366/247 |
| 7,815,130 | B2 | * | 10/2010 | Joseph et al. | 239/526 |
| 7,861,951 | B2 | | 1/2011 | Juo | |
| 7,967,040 | B1 | * | 6/2011 | Sanford | 141/319 |
| 7,980,755 | B2 | | 7/2011 | Renfro | |
| 8,371,483 | B2 | * | 2/2013 | Sanford | 222/570 |
| 8,403,236 | B2 | * | 3/2013 | Hughes et al. | 239/8 |
| 8,443,848 | B2 | * | 5/2013 | Hentzel et al. | 141/18 |
| 2001/0027985 | A1 | * | 10/2001 | Arabnia | 222/473 |
| 2003/0209568 | A1 | * | 11/2003 | Douglas et al. | 222/321.9 |
| 2004/0055259 | A1 | * | 3/2004 | Caruso | 53/471 |
| 2005/0045665 | A1 | * | 3/2005 | Krzywdziak et al. | 222/469 |
| 2006/0000838 | A1 | * | 1/2006 | Santrach | 220/700 |
| 2007/0131793 | A1 | * | 6/2007 | Joseph et al. | 239/302 |
| 2008/0029559 | A1 | * | 2/2008 | Selina et al. | 222/570 |
| 2008/0223810 | A1 | * | 9/2008 | Garcia | 215/201 |
| 2011/0253259 | A1 | * | 10/2011 | Sanford | 141/319 |
| 2013/0121105 | A1 | * | 5/2013 | Denize et al. | 366/347 |

* cited by examiner

*Primary Examiner* — Jason K Niesz
*Assistant Examiner* — Andrew Schmid
(74) *Attorney, Agent, or Firm* — Thomas C. Saitta

(57) ABSTRACT

A paint can lid assembly having a universal paint cup port member adapted to receive and retain a paint spray cup in an inverted position such that unused paint will drain from the paint spray cup back into the paint can. The paint cup port member has a tubular main body that extends through the upper surface of the mixing lid, the internal bore of the main body being sufficiently sized so as to receive the mating spout of any type or brand of paint spray cup. In a preferred embodiment, the paint cup port member is provided with an annular locking shoulder to better secure paint spray cups possessing retention clip members.

5 Claims, 2 Drawing Sheets

PAINT CAN COVER ASSEMBLY WITH PAINT RETURN PORT

BACKGROUND OF THE INVENTION

The present invention relates generally to cover assemblies for paint cans and, more particularly, to such cover assemblies having trigger-operated pour spouts.

There are a number of previously known cover assemblies for paint cans which are designed to overlie the open top of the paint can. Such cover assemblies include a spout and a cooperating closure which selectively opens and closes the spout upon operation of a lever or trigger mechanism. When the spout is open, paint can be readily poured from the can. With the spout closed, air loss is prevented in order to preserve the paint in the can. The cover assemblies are designed to be left on the paint cans until the paint cans are empty.

Many of these cover assemblies are designed for use with automatic paint stifling equipment, in which case they may be referred to as mixing lids. As such, they include a stirring assembly rotatably mounted to the cover assembly such that a stirrer is positioned within the can when the cover is in place. A drive member extends upwardly from the paint cover which cooperates with a drive member in a rack of the automatic paint stirring equipment in order to continuously stir the paint. Such automatic paint stifling equipment is typically used in automotive body repair shops and the like. In order to secure the cover assembly to the top of the paint can, typically two or more locking members are attached to the paint can lid. These locking members may be spring-loaded and, for example, may be rotatable between a locked and an unlocked position or presented as rocking tab members.

In many industries, such as the automobile painting industry, the paint is expensive. It is not uncommon for paint to cost $6-$7 per ounce. To apply the paint, a portion of the paint is poured from the can into a paint spray cup, which is then mounted onto a spray gun for pressurized application. When the painting process has been completed, any unused paint remaining in the paint spray cup is usually saved by plugging the paint spray cup and storing it on a shelf. This is problematical since an automobile dealer or body shop may apply hundreds of different colors, and storing and keeping track of each of the colors is difficult.

It is an object of this invention to provide a means, mechanism and method for easily returning the unused paint from the paint spray cup back into the original paint can without requiring removal of the cover assembly from the paint can. It is a further object to provide such means, mechanism and method wherein the paint spray cup may be retained atop the cover assembly and paint can in an inverted position so that the paint spray cup can be left in place until all of the paint has drained back into the paint can.

SUMMARY OF THE INVENTION

The invention is an improved paint can cover or lid assembly, particularly of the automatic mixing type, and the method of returning unused paint from a paint spray cup of the type used with paint spray guns, the improvement comprising providing a universal paint cup port member adapted to receive and retain a paint spray cup in an inverted position such that unused paint will drain from the paint spray cup back into the paint can. The paint cup port member comprises a tubular main body that extends through the upper surface of the mixing lid, the internal bore of the main body sufficiently sized so as to receive the mating spout of any type or brand of paint spray cup. In a preferred embodiment, the paint cup port member is provided with an annular locking shoulder to better secure paint spray cups possessing retention clip members. A sealing plug is provided to seal the port member when not in use. Preferably the port member is angled out of vertical such that the driver member of the mixing mechanism does not block proper positioning of the main body of the paint spray cup in the port member.

DETAILED DESCRIPTION OF THE INVENTION

With reference to the drawings, the invention in various embodiments will now be described, including mechanisms and methodologies. The illustrations and descriptions of certain embodiments are not meant to be exclusive or limiting.

Figure 1:
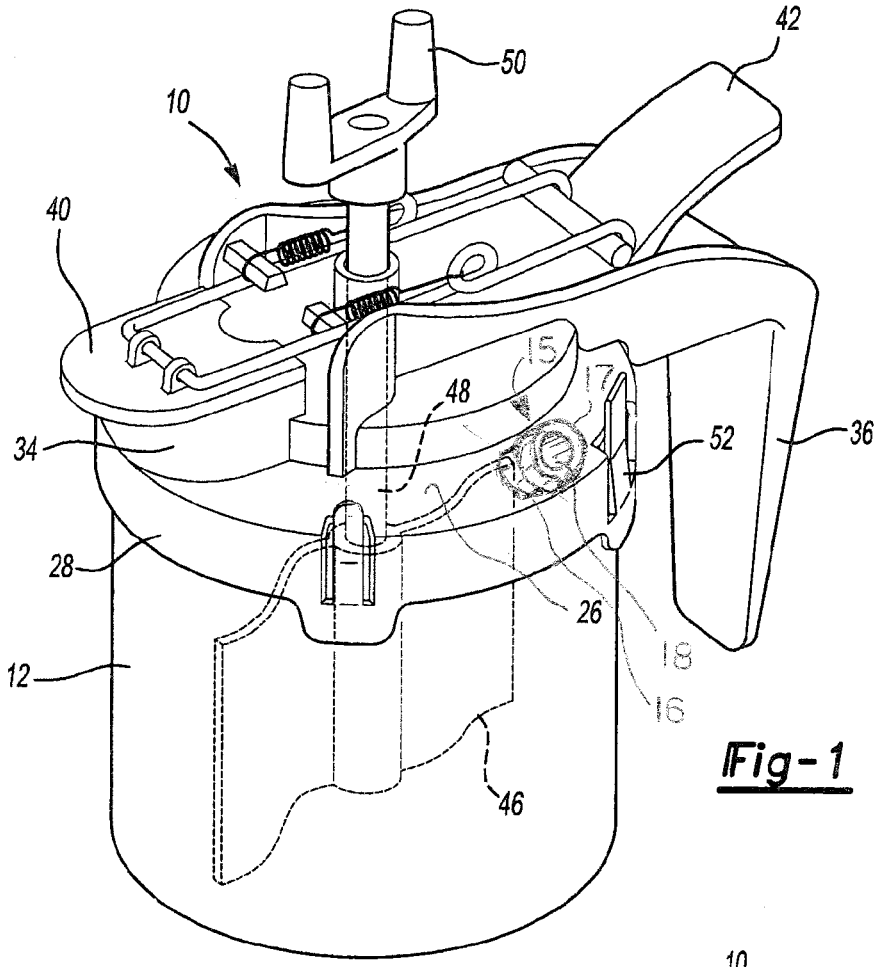
FIG. 1 is an illustration of a representative embodiment of the invention.
Figure 2:
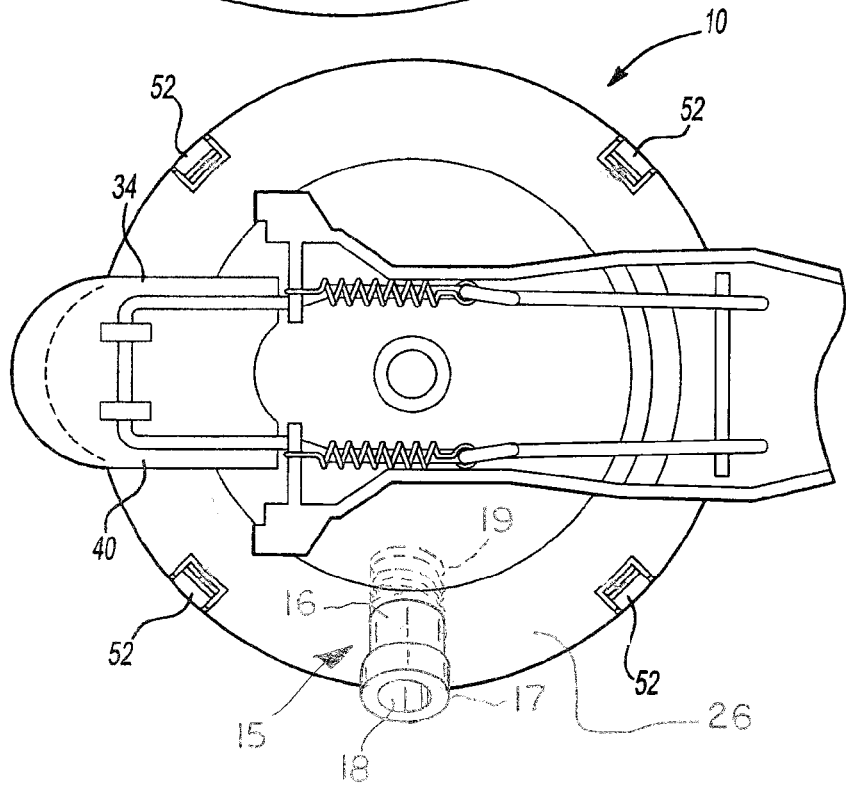
FIG. 2 is a top view showing the embodiment of FIG. 1 with the mixing mechanism removed for clarity.

As shown in FIGS. 1 and 2, the paint can cover or mixing lid assembly 10 is mounted onto an open-topped paint can 12 in a secured manner using locking members 52. The lid assembly 10 further comprises a lid upper surface 26, a lid skirt 28 depending from the lid upper surface 26 and surrounding the paint can 12, a pouring spout 34, a handle 36, a spout closure member 40 actuated by a trigger assembly 42 that when opened allows paint to be poured from the can 12. As shown in the drawings, a mixing lids 10 further comprises a stirrer member 46 mounted to a shaft 48 that extends through the lid upper surface 26. A driver member 50 is mounted to the exposed end of the shaft 48 for mating with automatic stirring equipment in known manner such that the paint within the can 12 may be stirred without removing the mixing lid assembly 10. It is to be understood that the cover or mixing lid assembly 10 may comprise different structural elements and designs from the representative depiction shown in FIGS. 1 and 2.

Figure 3:
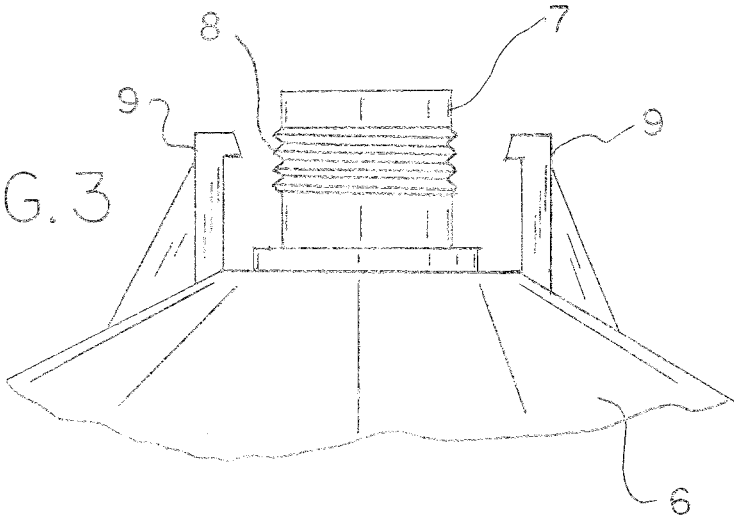
FIG. 3 is an illustration of a representative paint spray can mating spout.
Figure 4:
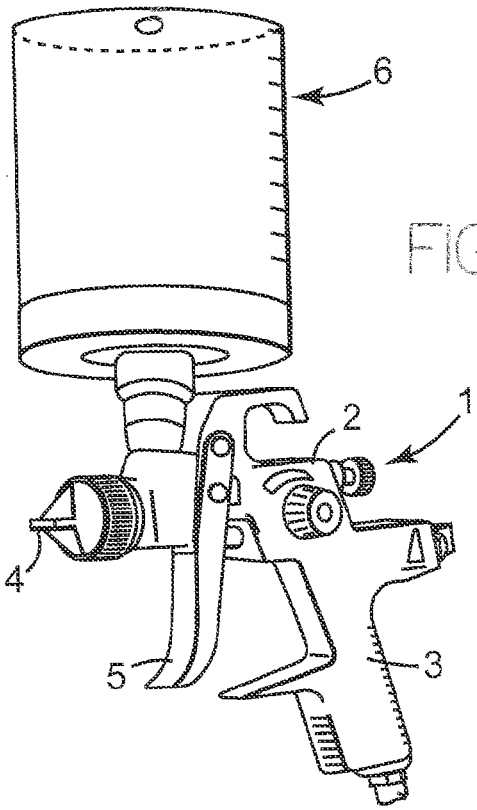
FIG. 4 is an illustration of prior art showing a representative paint spray can mounted onto a spray gun.

Paint from the can 12 is poured into a paint spray cup 6 that is adapted to be mounted upon and retained by a paint spray gun 1, as shown in a representative embodiment in FIGS. 3 and 4, which typically comprises a body 2, handle 3, nozzle 4 and trigger 5, the paint spray cup 6 having a mating spout 7 that is received and retained in known manner by the paint spray gun 1. Usually a collapsible bag (not shown) is provided within the paint spray cup 6 to retain the paint. Various embodiments for the mating spout 7 are known, and FIG. 3 illustrates a representative example that possesses various elements found singly or in combination with other types of paint spray cups 6. As shown the mating spout 7 is a tubular member that may be provided with external ridges or threading 8 and/or biased retention clip members 9. Corresponding mating structure is provided on the paint spray gun 6 to secure the paint spray cup 6 in place.

The paint can cover assembly or missing lid assembly 10 further comprises a universal paint cup receiving port member 15, which is different from and in addition to any additional venting ports that may be provided in the lid upper surface 26. The port member 15 is a tubular member sized and structured so as to receive the mating spout 7 of any of the common paint spray cups 6. The port member 15 comprises a tubular body 16 that extends through the lid upper surface 26, the body 16 having an inner bore 18. In a preferred embodiment as shown, the body 16 is provided with screw threading 19 for securing the port member 15 to the mixing lid 10, as this structure allows for easy retrofitting of existing mixing lids 10 by drilling a hole through the lid upper surface 26 and screwing in the port member 15. In another preferred embodiment, as shown in FIGS. 1 and 2, the port member 15 is provided with an annular locking shoulder 17 to mate with retention clip members 9. Other means for securing the port member 15 in the lid assembly 10 may also be utilized, such as for example utilizing mechanical fasteners. In addition, the port member 15 may be formed as an integral member of the lid upper surface 26. A port plug member (not shown) is utilized to seal the inner bore 18 when the port member 15 is not in use. Preferably, the port member 15 is angled from vertical as shown in the drawings such that any structures of the mixing lid assembly 10, such as for example the driver member 50, will not prevent the paint spray cup 6 from properly seating and mating with the port member 15 during the draining operation.

To return unused paint from a paint spray cup 6 back into a paint can 12 having a paint can cover or mixing lid 10 as set forth above, the inner bore 18 of the port member 15 is opened by removing its plug member. The paint spray cup 6 is then removed from the paint spray gun 1 and the mating spout 15 is inserted into the inner bore 18 of the port member 15, such that the paint spray cup 6 rests in an inverted position atop the paint can 12. Once the paint in the paint spray cup 6 has drained into the paint can 12, the paint spray cup 6 is removed from the port member 15 and the port member 15 is resealed.

It is understood that substitutions and equivalents for certain elements and structures set forth above may be obvious to one of skill in the art, and therefore the true scope and definition of the invention is to be as set forth in the following claims.

I claim:

1. A method of returning unused paint from a paint spray cup to a paint can through a paint can lid assembly affixed to a paint can, the paint spray cup having a mating spout, the method comprising the steps of:

providing a paint can lid assembly comprising a handle, a pouring spout, spout closure member actuated by a trigger assembly, a lid upper surface and paint spray cup port member extending through said lid upper surface, said paint spray cup port member comprising a tubular body and an inner bore;

affixing said paint can lid assembly atop a paint can;

inserting the mating spout of the paint spray cup into the inner bore of said paint spray cup port member; and allowing paint within the paint spray cup to drain through said paint spray cup port member and into the paint can.

2. The method of claim 1, said paint spray cup port member further comprising an annular locking shoulder and said paint spray cup further comprising retention clip members, whereby said step of inserting the mating spout of the paint spray cup into the inner bore of said paint spray cup port member comprises mating said retention clip members with said annular locking shoulder.

3. The method of claim 1, wherein said paint spray cup port member is disposed at a non-vertical angle, whereby said paint spray cup port member is inserted into the inner bore of said paint spray cup port member and retained at non-vertical angle.

4. The method of claim 1, further comprising the steps of drilling a hole through said lid upper surface of said paint can lid assembly and inserting said paint spray cup port member into said hole.

5. The method of claim 4, wherein said paint spray cup port member is screwed into said lid upper surface.

* * * * *